US010087916B2

(12) United States Patent
Asayama

(10) Patent No.: US 10,087,916 B2
(45) Date of Patent: Oct. 2, 2018

(54) FUEL PUMP

(71) Applicant: TOYOTA JIDOSHA KABUSHIKI KAISHA, Toyota-shi, Aichi-ken (JP)

(72) Inventor: Kazuhiro Asayama, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 219 days.

(21) Appl. No.: 15/272,946

(22) Filed: Sep. 22, 2016

(65) Prior Publication Data

US 2017/0096987 A1 Apr. 6, 2017

(30) Foreign Application Priority Data

Oct. 6, 2015 (JP) ..... 2015-198630

(51) Int. Cl.
*F04B 17/04* (2006.01)
*F04B 9/06* (2006.01)
(Continued)

(52) U.S. Cl.
CPC ..... *F04B 9/06* (2013.01); *F02M 37/043* (2013.01); *F02M 37/08* (2013.01); *F04B 1/02* (2013.01); *F04B 11/0075* (2013.01); *F04B 17/03* (2013.01); *F04B 19/22* (2013.01); *F04B 53/001* (2013.01)

(58) Field of Classification Search
CPC ..... F04B 9/06; F04B 53/001; F04B 11/0075; F04B 17/03; F04B 19/22; F04B 1/02; F04B 11/0033; F04B 25/005; F04B 27/005; F04B 49/12; F04B 19/20; F04B 23/04; F04B 23/06; F04B 17/04; F04B 17/042; F04B 17/044; F04B 35/04; F04B 34/045; F04B 43/02; F04B 45/04; F04B 45/047; F04B 11/00; F04B 53/14; F04B 53/16;
(Continued)

(56) References Cited

U.S. PATENT DOCUMENTS 3,286,911 A * 11/1966 Clarke ..... F04B 25/005 417/254
4,154,559 A * 5/1979 Enomoto ..... F04B 45/043 417/413.1
(Continued)

FOREIGN PATENT DOCUMENTS

JP 2000-008996 A 1/2000
JP 2008-545917 A 12/2008
(Continued)

*Primary Examiner* — Devon Kramer
*Assistant Examiner* — David Brandt
(74) *Attorney, Agent, or Firm* — Oliff PLC

(57) ABSTRACT

A fuel pump includes a first plunger that reciprocates in a first cylinder. The fuel pump further includes a first mover connected to the first plunger; a second mover that serves as a counterweight for suppressing vibration that occurs due to reciprocating movement of the first mover; an electromagnet and a magnetic member that are provided between the first mover and the second mover; a plate disposed between the first mover and the second mover; and a third spring and a fourth spring being a pair of springs sandwiching the plate between the third spring and the fourth spring, the third spring and the fourth spring having end portions connected to a housing.

4 Claims, 8 Drawing Sheets

(51) Int. Cl.

| | |
|---|---|
| ***F02M 37/04*** | (2006.01) |
| ***F02M 37/08*** | (2006.01) |
| ***F04B 1/02*** | (2006.01) |
| ***F04B 11/00*** | (2006.01) |
| ***F04B 17/03*** | (2006.01) |
| ***F04B 19/22*** | (2006.01) |
| ***F04B 53/00*** | (2006.01) |

(58) Field of Classification Search
CPC ..... F02M 37/08; F02M 37/043; F02M 37/04; F02M 59/025
See application file for complete search history.

(56) References Cited

U.S. PATENT DOCUMENTS

| | | | | |
|---|---|---|---|---|
| 5,907,201 | A * | 5/1999 | Hiterer | F02G 1/0435 310/15 |
| 5,944,302 | A * | 8/1999 | Loc | F04B 35/045 267/180 |
| 2008/0245097 | A1* | 10/2008 | Cho | F04B 25/00 62/510 |
| 2008/0271708 | A1 | 11/2008 | Rodriguez-Amaya | |
| 2014/0161650 | A1* | 6/2014 | Paweletz | F04B 17/03 417/415 |
| 2015/0098849 | A1* | 4/2015 | Bagagli | F04B 5/02 417/488 |
| 2017/0074255 | A1 | 3/2017 | Asayama | |

FOREIGN PATENT DOCUMENTS

| | | | |
|---|---|---|---|
| JP | 2014-117149 | A | 6/2014 |
| JP | 2017-053319 | A | 3/2017 |

* cited by examiner

FUEL PUMP

CROSS-REFERENCE TO RELATED APPLICATIONS

This application claims priority to Japanese Patent Application No. 2015-198630 filed on Oct. 6, 2015, the entire contents of which are hereby incorporated by reference.

BACKGROUND

1. Technical Field

The present disclosure relates to a fuel pump.

2. Description of Related Art

There is known a fuel pump that pressurizes fuel in a pressurizing chamber, defined by a cylinder and a plunger, by the movement of the plunger in the cylinder. As a drive mechanism for reciprocating such a plunger, a device described, for example, in Japanese Patent Application Publication No. 2014-117149 (JP 2014-117149 A) includes a mover that is reciprocated by an electromagnet, wherein a piston that serves as a plunger is connected to the mover.

In the meantime, when the mover is reciprocated, vibration occurs due to the reciprocating movement of the mover. Therefore, if, in order to suppress such vibration, a counterweight with a mass equal to that of the mover is provided and configured to move in a direction opposite to a moving direction of the plunger, the vibration that occurs due to the reciprocating movement of the mover can be canceled by vibration that occurs due to the reciprocating movement of the counterweight.

Herein, as a configuration for synchronizing the movement of the mover and the movement of the counterweight, a configuration may be considered in which an electromagnet is disposed between the mover and the counterweight to attract both the mover and the counterweight, while a spring is disposed between the mover and the counterweight to move the mover and the counterweight away from each other when the electromagnet is de-energized.

SUMMARY

However, with this configuration, since the mover and the counterweight are connected to each other via the spring, there is concern about the occurrence of the following disadvantage. That is, when pressurizing fuel in a pressurizing chamber, the load applied to the mover becomes greater than that applied to the counterweight. In this case, the plunger is difficult to move in an ascending direction (the moving direction of the plunger when the plunger moves in a direction to reduce the volume of the pressurizing chamber). Therefore, the entire reciprocating range of a reciprocating body constituted by the mover, the spring, and the counterweight is lowered in a descending direction of the plunger so that the top dead center position of the plunger is lowered. When the top dead center position of the plunger is lowered, the dead volume in the pressurizing chamber (the value equal to the volume in the pressurizing chamber when the plunger moves up to the top dead center) increases. Accordingly, even if the plunger is moved by the same stroke amount, the pressure rise of the fuel decreases compared to that before the top dead center position of the plunger is lowered. Therefore, the stroke amount of the plunger should be increased in order to obtain the same pressure rise so that there is a possibility of a reduction in pump efficiency.

Therefore, in view of these circumstances, the present disclosure provides a fuel pump that can suppress a reduction in pump efficiency that is caused by the lowering of a top dead center position of a plunger.

According to one aspect of the present disclosure, there is provided a fuel pump including a first pump portion, a first mover, a second mover, a housing, an electromagnet, a magnetic member, a plate, a first spring, a second spring, a third spring, and a fourth spring. The first pump portion includes a first cylinder, a first plunger, and a first pressurizing chamber. The first plunger is configured to reciprocate in the first cylinder. The first pressurizing chamber is defined by the first cylinder and the first plunger. The first pump portion is configured to pressurize fuel in the first pressurizing chamber by moving the first plunger in the first cylinder. The first mover is connected to the first plunger. The second mover is provided to face the first mover in a moving direction of the first plunger. The second mover is configured to serve as a counterweight configured to suppress vibration that occurs due to reciprocating movement of the first mover. The housing includes the first mover and the second mover inside the housing. The electromagnet is provided between the first mover and the second mover. The magnetic member is provided between the first mover and the second mover. The magnetic member is configured to attract both the first mover and the second mover when the electromagnet is energized. The plate is disposed between the first mover and the second mover. The first spring is disposed between the first mover and the plate. The second spring is disposed between the second mover and the plate. The third spring and the fourth spring are a pair of springs configured to sandwich the plate between the third spring and the fourth spring. End portions of the third spring and the fourth spring are connected to the housing.

According to the configuration of the fuel pump described above, when the electromagnet is energized, the first mover and the second mover are attracted to the electromagnet and the magnetic member such that the first mover and the second mover move toward each other. Since the first spring and the second spring are disposed between the first mover and the second mover, when the energization of the electromagnet is stopped, the first mover and the second mover move away from each other by urging forces of the first spring and the second spring. Therefore, by repeating the energization and the energization stop of the electromagnet, the first plunger connected to the first mover reciprocates, while the second mover serving as a counterweight for the first mover moves synchronously in a direction opposite to a moving direction of the first mover. Therefore, vibration that occurs due to the reciprocating movement of the first mover is canceled by vibration that occurs due to the reciprocating movement of the second mover.

According to the configuration described above, when the load applied to the first mover to which the first plunger is connected is greater than that applied to the second mover during pressurization of the fuel in the first pressurizing chamber, the entire reciprocating range of a reciprocating body constituted by the first mover, the first spring, the plate, the second spring, and the second mover is lowered in a descending direction of the first plunger so that the top dead center position of the first plunger is lowered. Herein, when the entire reciprocating range of the reciprocating body is lowered in the descending direction of the first plunger, the plate is lowered in the descending direction of the first plunger so that one of the third spring and the fourth spring sandwiching the plate between the third spring and the fourth spring is compressed in the descending direction of the first plunger, while the other is expanded in the descending direction of the first plunger. Consequently, an urging force acts on the plate to urge it in an ascending direction of the first plunger. Therefore, the lowering of the reciprocating body in the descending direction of the first plunger is suppressed and, as a result, the lowering of the top dead center position of the first plunger is also suppressed.

Therefore, according to the configuration described above, it is possible to suppress a reduction in pump efficiency that is caused by the lowering of the top dead center position of the first plunger. In the fuel pump, the third spring and the fourth spring may both be disposed in a pre-compressed state.

The greater the spring constant of the third spring and the fourth spring, the more the movement of the plate in the descending direction of the first plunger is suppressed and, therefore, the higher the effect of suppressing the lowering of the top dead center position of the first plunger.

Herein, as described above, when the plate is lowered in the descending direction of the first plunger, one of the third spring and the fourth spring sandwiching the plate therebetween is compressed in the descending direction of the first plunger, while the other is expanded in the descending direction of the first plunger. It is assumed that the lowering amount of the plate in the descending direction of the first plunger in this event is "L", that the spring constant of the third spring and the fourth spring is "K", and that initial urging forces that respectively act on the plate from the pre-compressed third and fourth springs are "F0 (F0 is a value obtained by multiplying a precompression amount of a spring by a spring constant)". It is further assumed that an urging force that acts on the plate from the fourth spring compressed in the descending direction of the first plunger is "F1" and that an urging force that acts on the plate from the third spring expanded in the descending direction of the first plunger is "F2". In this case, "F1" becomes "F0+KL" and "F2" becomes "F0−KL". Therefore, an urging force that acts on the plate in the ascending direction of the first plunger becomes "F1−F2=(F0+KL)−(F0−KL)=2KL" so that an effect is obtained which is the same as that when the spring constant K is doubled. Consequently, according to the configuration described above, it is possible to further suppress the lowering of the top dead center position of the first plunger.

The fuel pump may further include a second pump portion. The second pump portion may include a second cylinder, a second plunger, and a second pressurizing chamber. The second plunger may be connected to the second mover. The second plunger may be configured to reciprocate in the second cylinder. The second pressurizing chamber may be defined by the second cylinder and the second plunger. The second pump portion may be configured to pressurize fuel in the second pressurizing chamber by moving the second plunger in the second cylinder.

According to the configuration of the fuel pump described above, since the second plunger is reciprocated by the reciprocating second mover, the two pump portions can be driven by the single fuel pump without separately providing a drive mechanism for reciprocating the second plunger.

Further, in the fuel pump, a volume of the second pressurizing chamber and a specification of the second plunger may be set such that a pressure of the fuel pressurized in the second pressurizing chamber becomes smaller than a pressure of the fuel pressurized in the first pressurizing chamber.

According to the setting of the specifications of the respective portions in the fuel pump described above, it is possible to introduce a low fuel pressure, generated by the second pump portion, into the first pump portion and further to generate a higher fuel pressure by the first pump portion.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinbelow, an embodiment as one example of a fuel pump will be described in detail with reference to FIGS. 1 to 6. A fuel pump 50 of this embodiment is configured as a high-pressure fuel pump that is disposed in an in-cylinder injection type engine for a vehicle.

Figure 1:
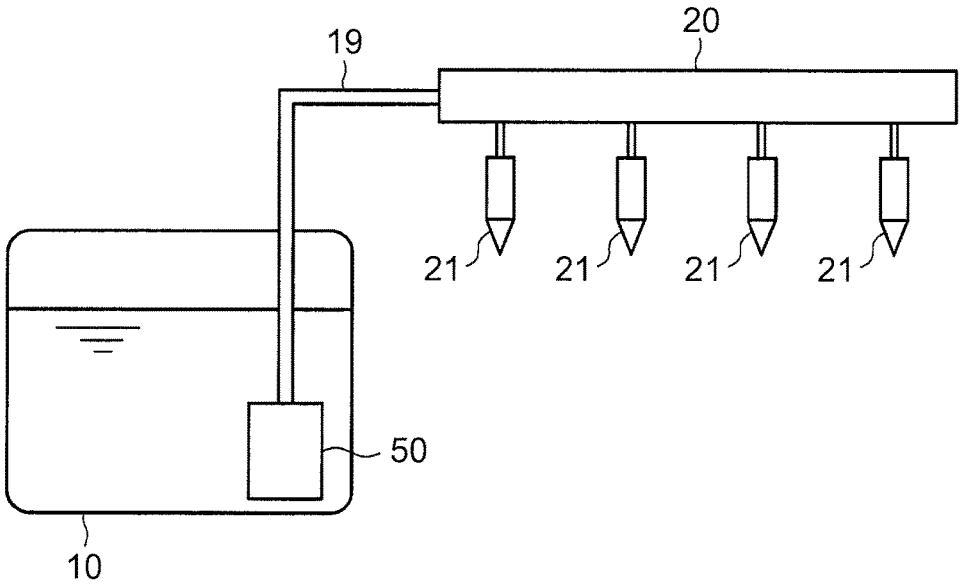
FIG. 1 is a schematic diagram exemplarily showing a configuration of a fuel system of an engine in which a fuel pump of an embodiment as one example of the present disclosure is disposed.

As shown in FIG. 1, the fuel pump 50 that pumps out and pressurizes fuel is disposed in a fuel tank 10 of the in-cylinder injection type engine. The fuel pump 50 is connected to a delivery pipe 20 via a high-pressure fuel passage 19. Injectors 21 disposed in respective cylinders of the in-cylinder injection type engine are connected to the delivery pipe 20.

Figure 2:
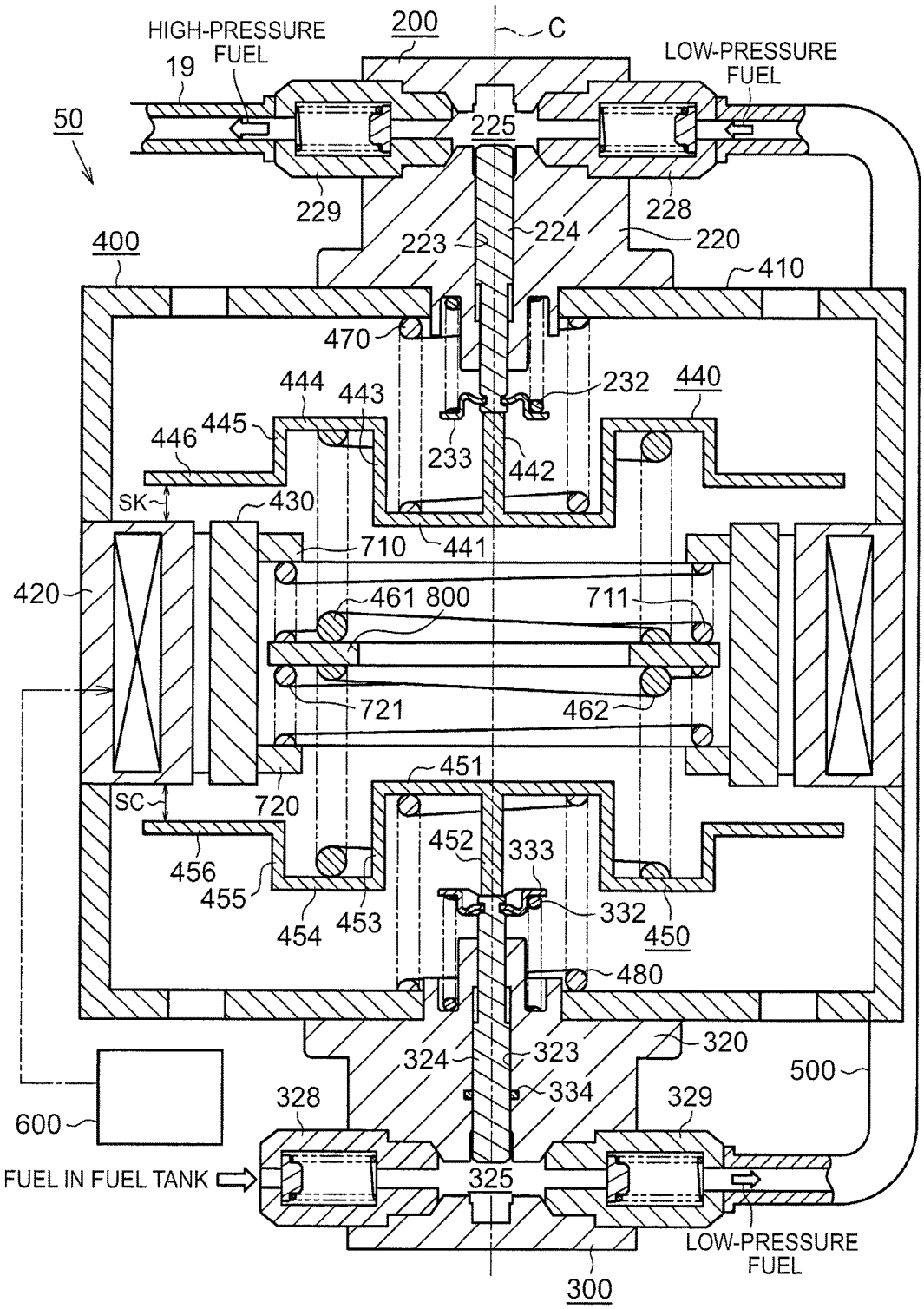
FIG. 2 is a sectional view of the fuel pump of the embodiment.

As shown in FIG. 2, the fuel pump 50 includes a first pump portion 200, a second pump portion 300, a drive portion 400, and a low-pressure fuel passage 500. The first pump portion 200 discharges high-pressure fuel. The second pump portion 300 discharges low-pressure fuel. The drive portion 400 drives the first pump portion 200 and the second pump portion 300. The low-pressure fuel passage 500 delivers the fuel from the second pump portion 300 to the first pump portion 200.

The first pump portion 200 includes a first pump body 220 formed therein with a first cylinder 223 of a tubular shape. A first plunger 224 in the form of a round bar is reciprocatingly disposed in the first cylinder 223. The first plunger 224 is disposed in a state where one end thereof is inserted inside the first cylinder 223, while the other end thereof protrudes to the outside of the first cylinder 223. The inside of the first cylinder 223 is comparted by the first plunger 224 so that a first pressurizing chamber 225 for pressurizing the fuel is formed in the first cylinder 223.

The first pump body 220 is provided with a first check valve 228 that allows the low-pressure fuel delivered through the low-pressure fuel passage 500 to flow into the first pressurizing chamber 225 and that blocks the fuel flow from the first pressurizing chamber 225 into the low-pressure fuel passage 500.

The first pump body 220 is further provided with a second check valve 229 that allows the high-pressure fuel pressurized in the first pressurizing chamber 225 to flow into the high-pressure fuel passage 19 and that blocks the fuel flow from the high-pressure fuel passage 19 into the first pressurizing chamber 225.

A first spring seat 233 of an annular shape is attached to an end portion, protruding to the outside of the first cylinder 223, of the first plunger 224. A seventh spring 232 is disposed between the first spring seat 233 and the first pump body 220 so as to urge the first plunger 224 in a direction away from the first pressurizing chamber 225.

The second pump portion 300 includes a second pump body 320 formed therein with a second cylinder 323 of a tubular shape. A second plunger 324 in the form of a round bar is reciprocatingly disposed in the second cylinder 323. The second plunger 324 is disposed coaxially with the first plunger 224. The second plunger 324 is disposed in a state where one end thereof is inserted inside the second cylinder 323, while the other end thereof protrudes to the outside of the second cylinder 323. In order to prevent the fuel from leaking from between an inner peripheral surface of the second cylinder 323 and an outer peripheral surface of the second plunger 324, a ring-shaped sealing member 334 is disposed on the inner peripheral surface of the second cylinder 323. The inside of the second cylinder 323 is comparted by the second plunger 324 so that a second pressurizing chamber 325 for pressurizing the fuel is formed in the second cylinder 323. Specifications including the volume of the second pressurizing chamber 325, the diameter of the second plunger 324, and so on are set so that the pressure of the fuel pressurized in the second pressurizing chamber 325 becomes smaller than that of the fuel pressurized in the first pressurizing chamber 225.

The second pump body 320 is provided with a third check valve 328 that allows the fuel in the fuel tank 10 to flow into the second pressurizing chamber 325 and that blocks the fuel flow from the second pressurizing chamber 325 into the fuel tank 10.

The second pump body 320 is further provided with a fourth check valve 329 that allows the low-pressure fuel pressurized in the second pressurizing chamber 325 to flow into the low-pressure fuel passage 500 and that blocks the fuel flow from the low-pressure fuel passage 500 into the second pressurizing chamber 325.

A second spring seat 333 of an annular shape is attached to an end portion, protruding to the outside of the second cylinder 323, of the second plunger 324. An eighth spring 332 is disposed between the second spring seat 333 and the second pump body 320 so as to urge the second plunger 324 in a direction away from the second pressurizing chamber 325.

The drive portion 400 includes a hollow cylindrical housing 410. The first pump portion 200 is attached to an outer peripheral surface of the housing 410 in such a way that the end portion, provided with the first spring seat 233, of the first plunger 224 is exposed to the inside of the housing 410.

The second pump portion 300 is attached to an outer peripheral surface of the housing 410 so as to face the first pump portion 200 in an extending direction of a central axis C of the first plunger 224 in such a way that the end portion, provided with the second spring seat 333, of the second plunger 324 is exposed to the inside of the housing 410.

A first mover 440 is disposed in the housing 410. The first mover 440 is generally disk-shaped and is made of a soft magnetic material. A first planar portion 441 of a disk shape is formed at a central portion of the first mover 440 so as to extend parallel to a radial direction of the first mover 440, and a first connecting portion 442 of a rod shape that is connected to the end portion of the first plunger 224 extends from a central portion of the first planar portion 441.

A first wall portion 443 of a hollow cylindrical shape is formed on the outer periphery of the first planar portion 441 so as to extend in a direction in which the first pump portion 200 is disposed, and a second planar portion 444 of an annular shape is formed at a distal end of the first wall portion 443 so as to extend parallel to the radial direction of the first mover 440.

A second wall portion 445 of a hollow cylindrical shape is formed on the outer periphery of the second planar portion 444 so as to extend in a direction opposite to the direction in which the first pump portion 200 is disposed, and a third planar portion 446 of an annular shape is formed at a distal end of the second wall portion 445 so as to extend parallel to the radial direction of the first mover 440.

Further, a second mover 450 is disposed in the housing 410 of the drive portion 400. The second mover 450 is disposed so as to face the first mover 440 in a moving direction of the first plunger 224.

The second mover 450 is generally disk-shaped and is made of a soft magnetic material. A fourth planar portion 451 of a disk shape is formed at a central portion of the second mover 450 so as to extend parallel to a radial direction of the second mover 450, and a second connecting portion 452 of a rod shape that is connected to the end portion of the second plunger 324 extends from a central portion of the fourth planar portion 451.

A third wall portion 453 of a hollow cylindrical shape is formed on the outer periphery of the fourth planar portion 451 so as to extend in a direction in which the second pump portion 300 is disposed, and a fifth planar portion 454 of an annular shape is formed at a distal end of the third wall portion 453 so as to extend parallel to the radial direction of the second mover 450.

A fourth wall portion 455 of a hollow cylindrical shape is formed on the outer periphery of the fifth planar portion 454 so as to extend in a direction opposite to the direction in which the second pump portion 300 is disposed, and a sixth planar portion 456 of an annular shape is formed at a distal end of the fourth wall portion 455 so as to extend parallel to the radial direction of the second mover 450.

The second mover 450 is provided so as to serve as a counterweight for suppressing vibration that occurs due to the reciprocating movement of the first mover 440. The thicknesses, the sizes, and so on of the first mover 440 and the second mover 450 are set so that the mass of the first mover 440 and the mass of the second mover 450 are substantially equal to each other. In order to make the mass of the first mover 440 and the mass of the second mover 450 equal to each other as much as possible, the first mover 440 or the second mover 450 may be formed with a mass-adjusting hole or added with a mass-adjusting weight.

In the housing 410, an electromagnet 420 is disposed annularly about the central axis C of the first plunger 224. A ring-shaped magnetic member 430 fixed to the housing 410 is disposed adjacent to the electromagnet 420 on the inner peripheral surface side of the electromagnet 420. The magnetic member 430 is made of a soft magnetic material such as iron.

The electromagnet 420 and the magnetic member 430 are disposed between the first mover 440 and the second mover 450. More specifically, the electromagnet 420 and the magnetic member 430 are configured to be interposed between the third planar portion 446 of the first mover 440 and the sixth planar portion 456 of the second mover 450.

A first fixing portion 710 of an annular shape and a second fixing portion 720 of an annular shape each being a part of the housing 410 and protruding toward the central axis C of the first plunger 224 are provided on the inner peripheral surface side of the magnetic member 430. The first fixing portion 710 and the second fixing portion 720 are respectively provided at positions spaced apart from each other in the extending direction of the central axis C of the first plunger 224.

An annular plate 800 with a hole formed at the center is disposed between the second planar portion 444 of the first mover 440 and the fifth planar portion 454 of the second mover 450. A central axis of the plate 800 is coaxial with the central axis C of the first plunger 224. The outer peripheral side of the plate 800 is disposed between the first fixing portion 710 and the second fixing portion 720.

A first spring 461 is disposed between the second planar portion 444 of the first mover 440 and the plate 800. The first mover 440 and the plate 800 are urged in directions away from each other by the first spring 461.

A second spring 462 is disposed between the fifth planar portion 454 of the second mover 450 and the plate 800. The second mover 450 and the plate 800 are urged in directions away from each other by the second spring 462.

Specifications of the first spring 461 and the second spring 462 are the same, and a central axis of the first spring 461 and a central axis of the second spring 462 are coaxial with the central axis C of the first plunger 224.

Since an urging force applied to the plate 800 from the first spring 461 is canceled by an urging force applied to the plate 800 from the second spring 462, urging forces of the first spring 461 and the second spring 462 act so that the first mover 440 and the second mover 450 are urged away from each other.

A third spring 711 and a fourth spring 721 are further disposed in the housing 410. The third spring 711 and the fourth spring 721 are a pair of springs sandwiching the plate 800 therebetween and have end portions connected to the housing 410.

The third spring 711 is disposed in a pre-compressed state between the first fixing portion 710 and the plate 800. One of both end portions of the third spring 711 is connected to the first fixing portion 710, while the other end portion is connected to the plate 800.

The fourth spring 721 is the same as the third spring 711 and is disposed between the second fixing portion 720 and the plate 800 in a state of being pre-compressed by the same amount as the third spring 711. One of both end portions of the fourth spring 721 is connected to the second fixing portion 720, while the other end portion is connected to the plate 800.

Since the third spring 711 is disposed in the pre-compressed state, the non-loose state thereof is held between the first fixing portion 710 and the plate 800. Therefore, the occurrence of hitting sound due to hitting of the third spring 711 on the first fixing portion 710 or the plate 800 is suppressed. Likewise, since the fourth spring 721 is also disposed in the pre-compressed state, the non-loose state thereof is held between the second fixing portion 720 and the plate 800. Therefore, the occurrence of hitting sound due to hitting of the fourth spring 721 on the second fixing portion 720 or the plate 800 is also suppressed.

A fifth spring 470 is disposed between the first planar portion 441 of the first mover 440 and an inner wall, facing the first planar portion 441, of the housing 410 so as to urge the first mover 440 in a direction toward the magnetic member 430.

Further, a sixth spring 480 is disposed between the fourth planar portion 451 of the second mover 450 and an inner wall, facing the fourth planar portion 451, of the housing 410 so as to urge the second mover 450 in a direction toward the magnetic member 430. The sixth spring 480 is of the same specification as the fifth spring 470. The spring constant of the fifth spring 470 and the sixth spring 480 is set to be sufficiently smaller than that of the first spring 461 and the second spring 462, thereby preventing the spacing between the first mover 440 and the second mover 450 achieved by the first spring 461 and the second spring 462 from being hindered by urging forces of the fifth spring 470 and the sixth spring 480.

The shapes, the disposing positions, and so on of the first mover 440 and the second mover 450 are set so that a distance SK between the third planar portion 446 of the first mover 440 and the electromagnet 420 becomes equal to a distance SC between the sixth planar portion 456 of the second mover 450 and the electromagnet 420 in a state where the first mover 440 and the second mover 450 are spaced apart from each other to the maximum by the urging forces of the first spring 461 and the second spring 462.

In this way, the first mover 440 and the second mover 450 are movably held in the housing 410 by the urging forces of the first spring 461, the second spring 462, the fifth spring 470, and the sixth spring 480.

Figure 3:
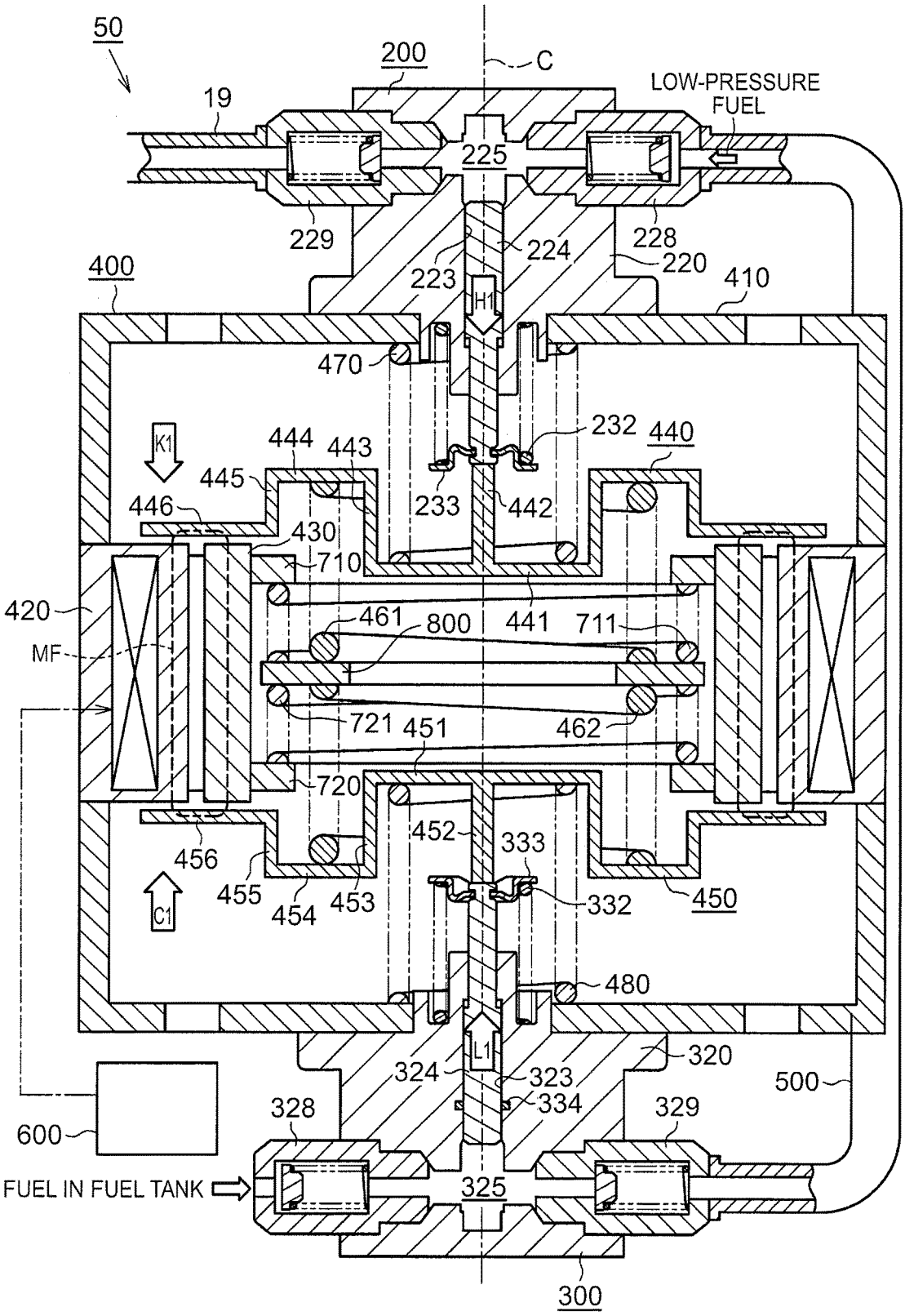
FIG. 3 is a sectional view showing a state of the fuel pump of the embodiment when an electromagnet is energized.

A control device 600 for performing an energization control is connected to the electromagnet 420. As shown in FIG. 3, when the electromagnet 420 is energized, since the first mover 440, the second mover 450, and the magnetic member 430 are each made of the soft magnetic material, the magnetic flux MF (shown in broken lines in FIG. 3) generated by the electromagnet 420 flows annularly through the electromagnet 420, the third planar portion 446 of the first mover 440, the magnetic member 430, the sixth planar portion 456 of the second mover 450, and the electromagnet 420. That is, a magnetic circuit is formed by the first mover 440, the second mover 450, the magnetic member 430, and the electromagnet 420. As a result, the first mover 440 and the second mover 450 are attracted to the electromagnet 420 and the magnetic member 430 so that the first mover 440 moves in a direction toward the magnetic member 430 (direction of arrow K1 shown in FIG. 3) and that the second mover 450 also moves in a direction toward the magnetic member 430 (direction of arrow C1 shown in FIG. 3). Accordingly, when the electromagnet 420 is energized, the first mover 440 and the second mover 450 move toward each other.

When the first mover 440 is attracted by the electromagnet 420 and the magnetic member 430 to move in the direction of arrow K1, the first plunger 224 connected to the first connecting portion 442 moves in a direction in which the volume of the first pressurizing chamber 225 increases (direction of arrow H1 shown in FIG. 3). In this embodiment, the movement of a plunger in a direction in which the volume of a pressurizing chamber increases is defined as descending of the plunger. When the first plunger 224 descends in this way, the pressure in the first pressurizing chamber 225 decreases so that the fuel is sucked into the first pressurizing chamber 225 through the first check valve 228 from the low-pressure fuel passage 500.

Likewise, when the second mover 450 is attracted by the electromagnet 420 and the magnetic member 430 to move in the direction of arrow C1, the second plunger 324 connected to the second connecting portion 452 moves in a direction in which the volume of the second pressurizing chamber 325 increases (direction of arrow L1 shown in FIG. 3). When the second plunger 324 descends in the second cylinder 323 in this way, the pressure in the second pressurizing chamber 325 decreases so that the fuel in the fuel tank 10 is sucked into the second pressurizing chamber 325 through the third check valve 328.

Figure 4:
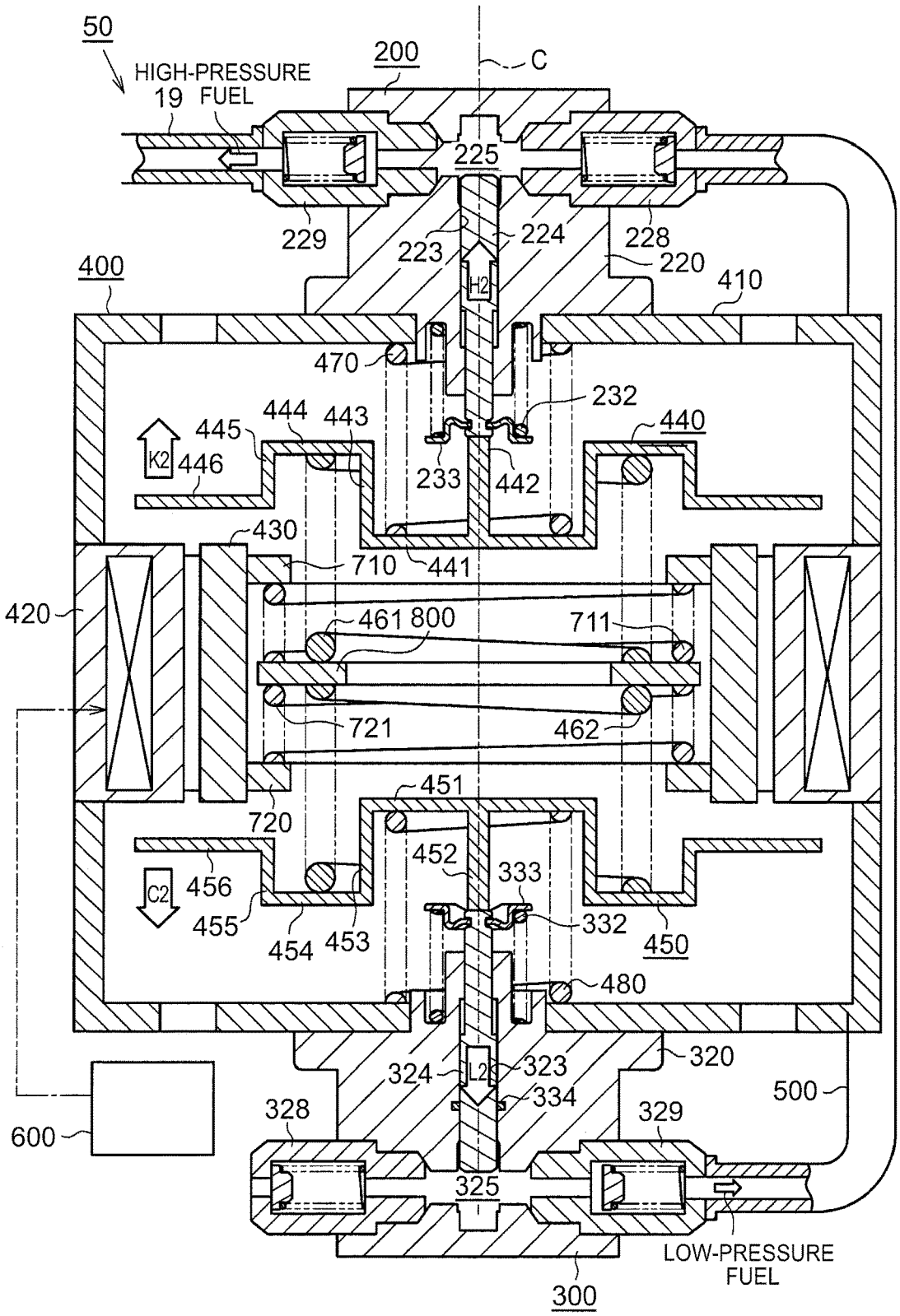
FIG. 4 is a sectional view showing a state of the fuel pump of the embodiment when the energization of the electromagnet is stopped.

As shown in FIG. 4, when the energization of the electromagnet 420 is stopped, the first mover 440 and the second mover 450 move away from each other by the urging forces of the first spring 461 and the second spring 462. That is, the first mover 440 moves in a direction away from the magnetic member 430 (direction of arrow K2 shown in FIG. 4), while the second mover 450 also moves in a direction away from the magnetic member 430 (direction of arrow C2 shown in FIG. 4).

When the first mover 440 moves in the direction of arrow K2, the first plunger 224 connected to the first connecting portion 442 moves in a direction in which the volume of the first pressurizing chamber 225 decreases (direction of arrow H2 shown in FIG. 4). In this embodiment, the movement of a plunger in a direction in which the volume of a pressurizing chamber decreases is defined as ascending of the plunger. When the first plunger 224 ascends in this way, the fuel in the first pressurizing chamber 225 is pressurized and discharged into the high-pressure fuel passage 19 through the second check valve 229.

Likewise, when the second mover 450 moves in the direction of arrow C2, the second plunger 324 connected to the second connecting portion 452 moves in a direction in which the volume of the second pressurizing chamber 325 decreases (direction of arrow L2 shown in FIG. 4). When the second plunger 324 ascends in this way, the fuel in the second pressurizing chamber 325 is pressurized and discharged into the low-pressure fuel passage 500 through the fourth check valve 329.

In this way, the fuel in the fuel tank 10 is sucked by the second pump portion 300 and then delivered to the first pump portion 200 through the low-pressure fuel passage 500. The low-pressure fuel delivered to the first pump portion 200 is further pressurized in the first pressurizing chamber 225 of the first pump portion 200 and discharged into the high-pressure fuel passage 19.

The discharge amounts of the first pump portion 200 and the second pump portion 300 provided in the fuel pump 50 are variably set by changing the stroke amounts ST of the first plunger 224 and the second plunger 324.

That is, the distance SK between the first mover 440 and the magnetic member 430 and the distance SC between the second mover 450 and the magnetic member 430 change according to an energization state of the electromagnet 420. Specifically, the distance SK and the distance SC decrease when the electromagnet 420 is energized, while the distance SK and the distance SC increase when the energization of the electromagnet 420 is stopped. Hereinafter, this change in distance between the mover and the magnetic member 430 will be referred to as an operation amount of the mover. Assuming that the operation amount is "0" in the state where the first mover 440 and the second mover 450 are spaced apart from each other to the maximum by the urging forces of the first spring 461 and the second spring 462, the operation amounts of the first mover 440 and the second mover 450 become "0" when the first plunger 224 and the second plunger 324 are each at its top dead center position (the position at which the movement of the plunger changes from ascending to descending). In this case, as the operation amounts of the first mover 440 and the second mover 450 increase, i.e. as the first mover 440 and the second mover 450 approach closer to the electromagnet 420 and the magnetic member 430, the stroke amount ST (descending amount) of the first plunger 224 from the top dead center position and the stroke amount ST (descending amount) of the second plunger 324 from the top dead center position increase. Therefore, more fuel is sucked into the first pressurizing chamber 225 and the second pressurizing chamber 325 so that the discharge amounts of the first pump portion 200 and the second pump portion 300 increase.

Figure 5:
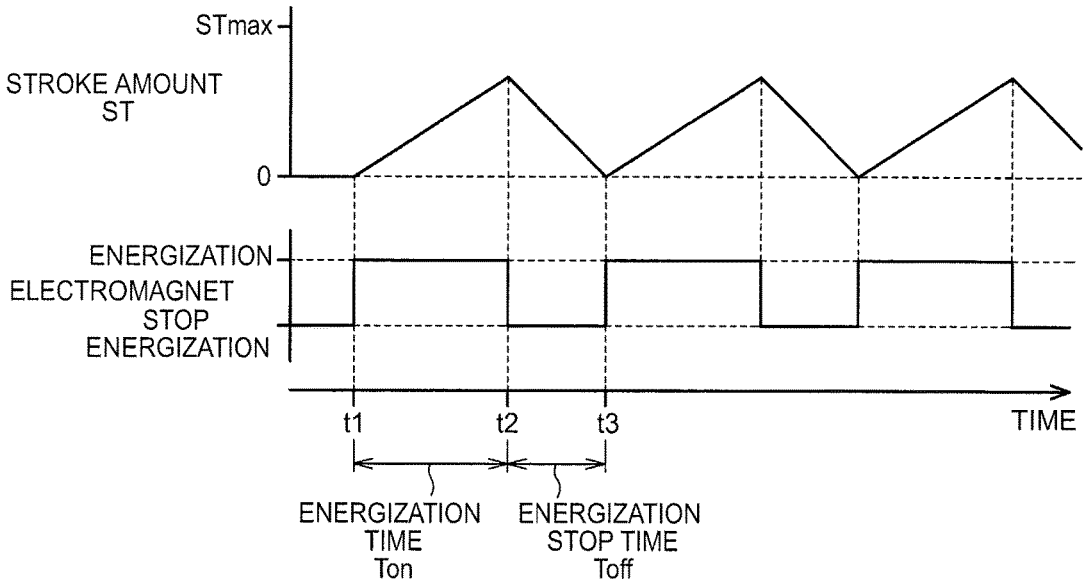
FIG. 5 is a timing chart showing the relationship between an energization state of the electromagnet and a stroke amount of a plunger which are disposed in the fuel pump of the embodiment.

As shown in FIG. 5, when the electromagnet 420 is energized, the first mover 440 and the second mover 450 approach the electromagnet 420 and the magnetic member 430 so that the longer an energization time Ton of the electromagnet 420, the greater the stroke amounts ST of the first plunger 224 and the second plunger 324. At a time point at which the first mover 440/the second mover 450 approaches and contacts the electromagnet 420 and the magnetic member 430, the increase of the stroke amount ST is stopped so that the stroke amount ST reaches a maximum stroke amount STmax.

When the energization of the electromagnet 420 is stopped, the first mover 440 and the second mover 450 approaching the electromagnet 420 and the magnetic member 430 move away from the electromagnet 420 and the magnetic member 430 and, after the lapse of a predetermined time from the time point of stopping the energization, the operation amount of the first mover 440/the second mover 450 becomes "0" so that the stroke amount ST also becomes "0". The greater the stroke amount ST of the first plunger 224/the second plunger 324, the longer an energization stop time Toff of the electromagnet 420 that is required for the stroke amount ST to become "0" after the energization of the electromagnet 420 is stopped, and therefore, the energization stop time Toff of the electromagnet 420 can be set based on the energization time Ton of the electromagnet 420.

Assuming that the discharge amount of the high-pressure fuel discharged from the first pump portion 200 is a required discharge amount of the fuel pump 50, the control device 600 sets the energization time Ton based on the required discharge amount of the fuel pump 50 so that the greater the required discharge amount, the longer the energization time Ton. Further, the control device 600 sets the energization stop time Toff so that the longer the set energization time Ton, the longer the energization stop time Toff. The control device 600 adjusts the discharge amount of the fuel pump 50 to a desired required discharge amount by alternately repeating the energization of the electromagnet 420 by the energization time Ton and the energization stop of the electromagnet 420 by the energization stop time Toff.

The energization control described above is only one example for adjusting the stroke amount ST. The stroke amount ST may be changed in another way. Next, the operation of the fuel pump 50 will be described.

As described above, when the electromagnet 420 is energized, since the first mover 440 and the second mover 450 are attracted to the electromagnet 420 and the magnetic member 430, the first mover 440 and the second mover 450 move toward each other. When the energization of the electromagnet 420 is stopped, the first mover 440 and the second mover 450 move away from each other by the urging forces of the first spring 461 and the second spring 462.

Therefore, by repeating the energization and the energization stop of the electromagnet 420, the first plunger 224 connected to the first mover 440 reciprocates, while the second mover 450 serving as a counterweight for the first mover 440 moves synchronously in a direction opposite to a moving direction of the first mover 440. Therefore, vibration that occurs due to the reciprocating movement of the first mover 440 is canceled by vibration that occurs due to the reciprocating movement of the second mover 450.

Figure 6:
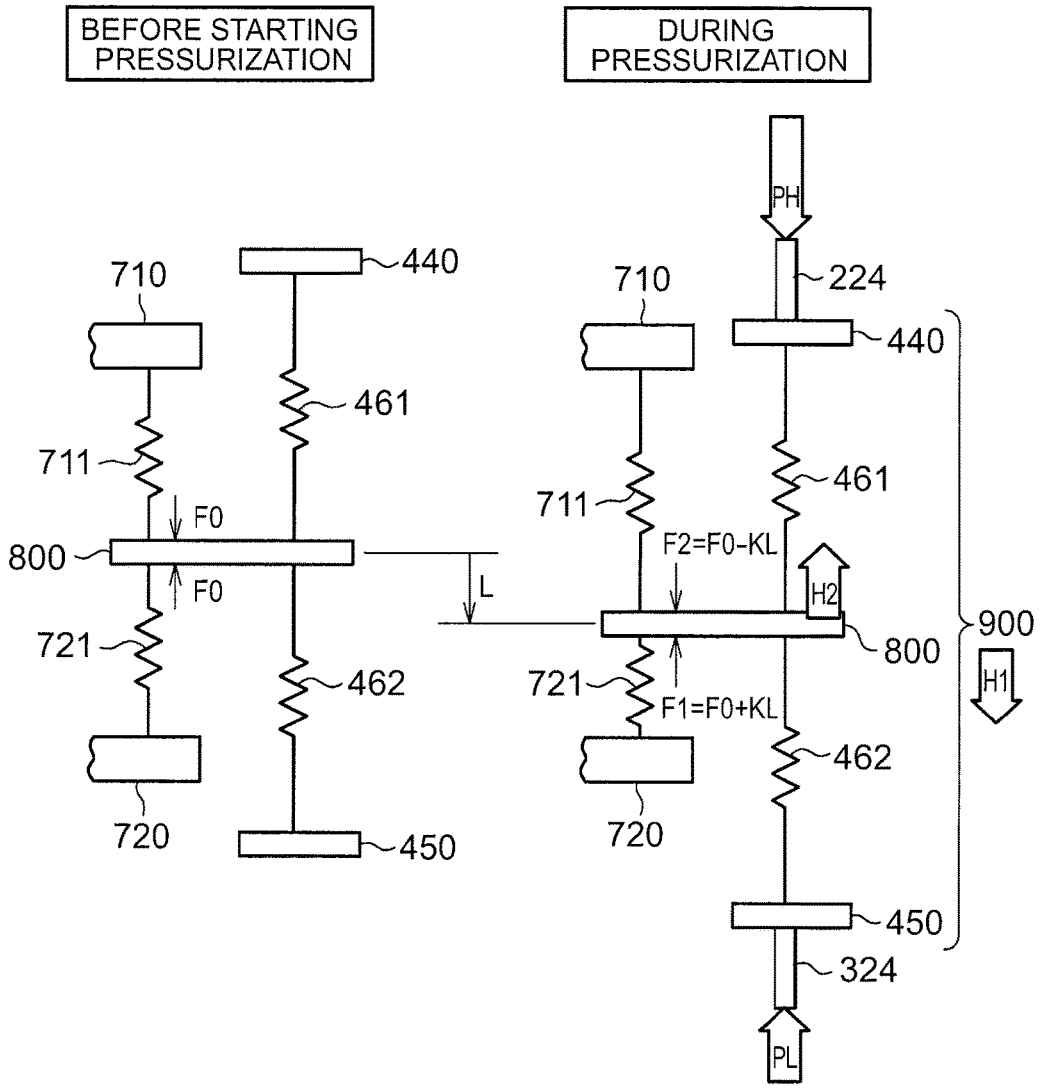
FIG. 6 is an exemplary diagram showing an arrangement of springs disposed in the fuel pump of the embodiment.

As shown on the right side in FIG. 6, when the fuel is pressurized in the first pressurizing chamber 225 and the second pressurizing chamber 325 (described as "DURING PRESSURIZATION" in FIG. 6), a fuel pressure PH in the first pressurizing chamber 225 is higher than a fuel pressure PL in the second pressurizing chamber 325. Therefore, the load applied to the first mover 440 to which the first plunger 224 is connected becomes greater than that applied to the second mover 450 to which the second plunger 324 is connected.

In this case, the entire reciprocating range of a reciprocating body 900 constituted by the first mover 440, the first spring 461, the plate 800, the second spring 462, and the second mover 450 is lowered in a descending direction of the first plunger 224 (arrow H1 direction shown in FIG. 6) compared to a state before starting pressurization of the fuel (the state shown on the left side in FIG. 6). Therefore, the top dead center position of the first plunger 224 is lowered.

Herein, when the entire reciprocating range of the reciprocating body 900 is lowered in the descending direction of the first plunger 224, the plate 800 is lowered in the descending direction of the first plunger 224. Therefore, the fourth spring 721 being one of the pair of springs sandwiching the plate 800 therebetween and disposed between the plate 800 and the second fixing portion 720 is compressed in the descending direction of the first plunger 224.

On the other hand, the third spring 711 being the other of the pair of springs sandwiching the plate 800 therebetween and disposed between the plate 800 and the first fixing portion 710 is expanded in the descending direction of the first plunger 224.

By the compression of the fourth spring 721 and the expansion of the third spring 711, an urging force acts on the plate 800 to urge it in an ascending direction of the first plunger 224 (arrow H2 direction shown in FIG. 6). Therefore, the lowering of the reciprocating body 900 in the descending direction of the first plunger 224 is suppressed and, as a result, the lowering of the top dead center position of the first plunger 224 is also suppressed.

Since the third spring 711 and the fourth spring 721 are disposed in the pre-compressed state, the following action is obtained. That is, the greater the spring constant of the third spring 711 and the fourth spring 721, the more the movement of the plate 800 in the descending direction of the first plunger 224 is suppressed and, therefore, the higher the effect of suppressing the lowering of the top dead center position of the first plunger 224.

Herein, as described above with reference to FIG. 6, when the plate 800 is lowered in the descending direction of the first plunger 224, the fourth spring 721 is compressed in the descending direction of the first plunger 224, while the third spring 711 is expanded in the descending direction of the first plunger 224. It is assumed that the lowering amount of the plate 800 in the descending direction of the first plunger 224 in this event is "L" and that the spring constant of the third spring 711 and the fourth spring 721 is "K". It is further assumed that initial urging forces that respectively act on the plate 800 from the third spring 711 and the fourth spring 721 disposed in the pre-compressed state are "F0". The initial urging force F0 is a value obtained by multiplying a pre-compression amount of the spring 711, 721 by the spring constant K of the spring 711, 721 and is a force equal to each of urging forces that respectively act on the plate 800 from the third spring 711 and the fourth spring 721 before starting pressurization of the fuel.

It is further assumed that an urging force that acts on the plate 800 from the fourth spring 721 compressed in the descending direction of the first plunger 224 during pressurization is "F1" and that an urging force that acts on the plate 800 from the third spring 711 expanded in the descending direction of the first plunger 224 during pressurization is "F2". In this case, the urging force F1 of the fourth spring 721 becomes "F0+KL", while the urging force F2 of the third spring 711 becomes "F0−KL". Therefore, an urging force that acts on the plate 800 in the ascending direction H2 of the first plunger 224 becomes "F1−F2=(F0+KL)−(F0−KL)=2KL" so that an effect is obtained which is the same as that when the spring constant K is doubled.

Incidentally, the third spring 711, the fourth spring 721, the plate 800, and so on may be omitted, and the first spring 461 and the second spring 462 may be formed by a single spring. Further, a first auxiliary spring assisting the urging force of the fifth spring 470 may be disposed between the first mover 440 and the housing 410, while a second auxiliary spring assisting the urging force of the sixth spring 480 may be disposed between the second mover 450 and the housing 410.

Also in this configuration, when the load applied to the first mover 440 to which the first plunger 224 is connected is greater than that applied to the second mover 450 to which the second plunger 324 is connected, the first mover 440 and the second mover 450 are lowered in the descending direction of the first plunger 224. Herein, when the second mover 450 is lowered in the descending direction of the first plunger 224, an urging force of the second auxiliary spring increases so that an urging force acts on the second mover 450 to urge it in the ascending direction of the first plunger 224.

By the increase in the urging force of the second auxiliary spring, the lowering of the first mover 440 and the second mover 450 in the descending direction of the first plunger 224 is suppressed and, as a result, the lowering of the top dead center position of the first plunger 224 is also suppressed. However, in the case of this configuration, the expansion/contraction amount of the second auxiliary spring when the fuel pump 50 is driven becomes a value obtained by adding together an expansion/contraction amount caused by the reciprocating movement of the second mover 450 and a lowering amount caused by the lowering of the second mover 450 in the descending direction of the first plunger 224 (the amount corresponding to the lowering amount L of the plate 800).

On the other hand, in the embodiment described above, the expansion/contraction amount of each of the third spring 711 and the fourth spring 721 is only an amount corresponding to the lowering amount L of the plate 800 and thus is smaller than the expansion/contraction amount of the second auxiliary spring. Herein, generally, when designing a spring, assuming that the conditions such as the maximum stress, the wire diameter, and the coil center diameter are the same, the actual number of turns of the spring can be reduced as the expansion/contraction amount of the spring decreases, while the spring constant becomes greater as the actual number of turns of the spring decreases. Therefore, compared to the case where the auxiliary springs are disposed at the positions described above, disposing the third spring 711 and the fourth spring 721 at the positions described above is advantageous in that the spring constant can be made greater.

As described above, the following effects can be obtained according to this embodiment. (1) It is configured that the first mover 440 connected to the first plunger 224 and the second mover 450 serving as the counterweight reciprocate synchronously by the electromagnet 420, the magnetic member 430, the first spring 461, and the second spring 462. Therefore, vibration that occurs due to the reciprocating movement of the first mover 440 can be canceled by vibration that occurs due to the reciprocating movement of the second mover 450.

(2) Even when the load applied to the first mover 440 to which the first plunger 224 is connected is greater than that applied to the second mover 450 to which the second plunger 324 is connected, the lowering of the top dead center position of the first plunger 224 can be suppressed. Therefore, it is possible to suppress a reduction in pump efficiency that is caused by the lowering of the top dead center position of the first plunger 224.

(3) By disposing the third spring 711 and the fourth spring 721 in the pre-compressed state, when the plate 800 is lowered, the effect is obtained which is the same as that when the spring constant K of the springs 711 and 721 is doubled. Therefore, compared to a case where the third spring 711 and the fourth spring 721 are disposed in a non-pre-compressed state, i.e. in a free-length state, it is possible to further suppress the lowering of the top dead center position of the first plunger 224.

(4) Since the second plunger 324 is reciprocated by the reciprocating second mover 450, the two pump portions can be driven by the single fuel pump without separately providing a drive mechanism for reciprocating the second plunger 324.

The embodiment described above can be carried out by changing it as follows.

i) Although the fuel pump 50 includes the second pump portion 300 that discharges the low-pressure fuel, the second pump portion 300 and so on may be omitted.

Figure 7:
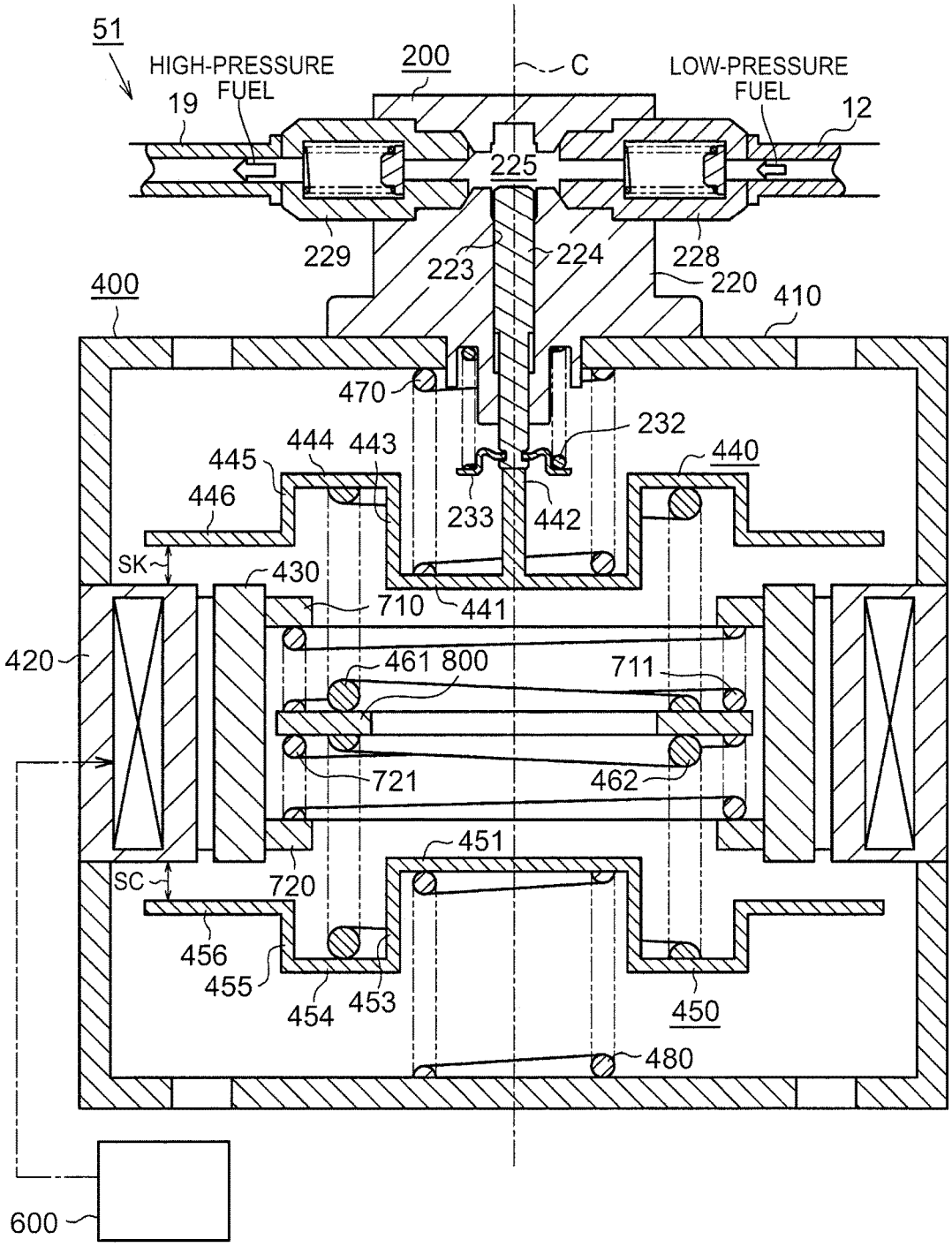
FIG. 7 is a sectional view showing a modification of the fuel pump of the embodiment.

FIG. 7 shows a sectional structure of a fuel pump 51 in this modification. With respect to configurations in the fuel pump 51 shown in FIG. 7 that are common to the above-described embodiment, detailed description thereof will be omitted by assigning the same symbols thereto. As shown in FIG. 7, in the fuel pump 51 of this modification, compared to the fuel pump 50 of the above-described embodiment, the second pump portion 300, the low-pressure fuel passage 500 connecting between the second pump portion 300 and the first pump portion 200, and the second connecting portion 452 provided at the central portion of the fourth planar portion 451 of the second mover 450 are omitted.

Figure 8:
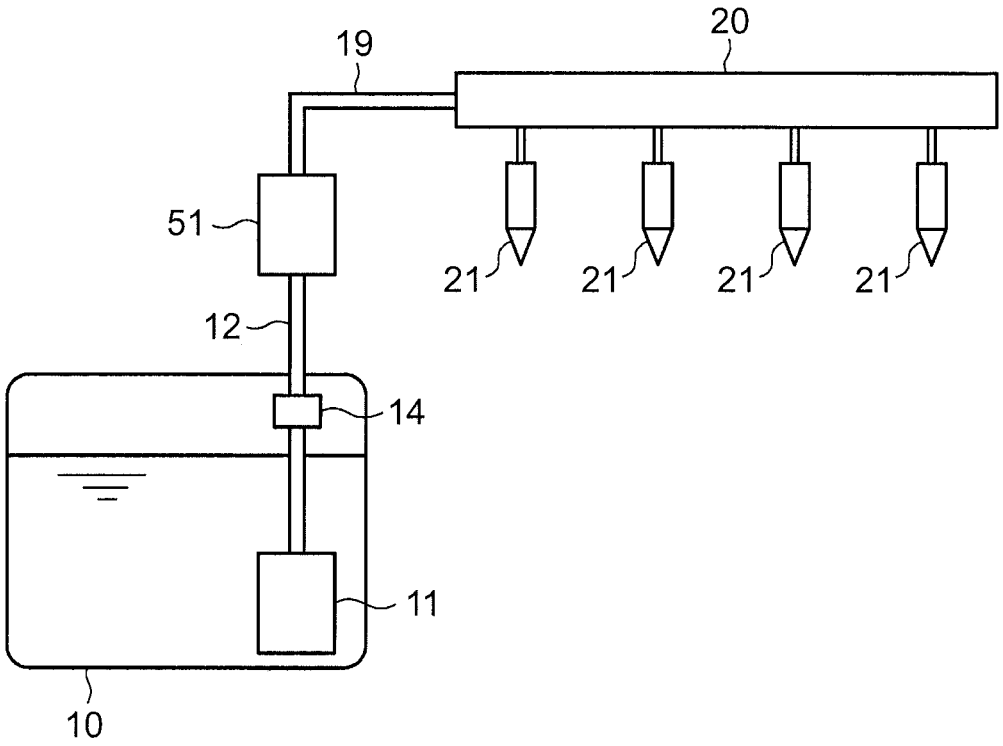
FIG. 8 is a schematic diagram exemplarily showing a configuration of a fuel system of an engine in which the fuel pump of the modification is disposed.

Referring to FIG. 8 in addition to FIG. 7, a feed pump 11 that pumps out fuel is disposed in a fuel tank 10 of an in-cylinder injection type engine including the fuel pump 51. The feed pump 11 is connected to a first check valve 228 of the fuel pump 51 via a low-pressure fuel passage 12. The low-pressure fuel passage 12 is provided with a regulator 14 that discharges the fuel in the low-pressure fuel passage 12 to the fuel tank 10 when the fuel pressure in the low-pressure fuel passage 12 exceeds a prescribed value. A second check valve 229 of the fuel pump 51 is connected to a high-pressure fuel passage 19.

Also in the fuel pump 51 thus configured, since the load applied to a first mover 440 to which a first plunger 224 is connected becomes greater than that applied to a second mover 450, the top dead center position of the first plunger 224 is lowered as in the above-described embodiment. However, since the above-described action which is caused by including a third spring 711, a fourth spring 721, a plate 800, and so on is obtained also in the fuel pump 51, it is possible to suppress a reduction in pump efficiency that is caused by the lowering of the top dead center position of the first plunger 224.

ii) Although the third spring 711 and the fourth spring 721 are disposed in the pre-compressed state, they may be disposed without being pre-compressed. Even in this case, the effects other than the above-described effect (3) can be obtained.

iii) Although the stroke amount ST of the first plunger 224 is changed in order to variably set the discharge amount of the fuel pump 50, the stroke amount ST may be set to a fixed amount when the discharge amount is not changed.

iv) The shapes of the electromagnet 420, the magnetic member 430, the first mover 440, the second mover 450, the plate 800, the first fixing portion 710, and the second fixing portion 720 are only by way of example and may be changed as appropriate.

While the present disclosure has been described with reference to example embodiments thereof, it is to be understood that the present disclosure is not limited to the described example embodiments or constructions. To the contrary, the present disclosure is intended to cover various modifications and equivalent arrangements. In addition, while the various elements of the example embodiments are shown in various combinations and configurations, other combinations and configurations, including more, less or only a single element, are also within the scope of the present disclosure.

What is claimed is:

1. A fuel pump comprising:

a first pump portion including a first cylinder, a first plunger, and a first pressurizing chamber, the first plunger being configured to reciprocate in the first cylinder, the first pressurizing chamber being defined by the first cylinder and the first plunger, and the first pump portion being configured to pressurize fuel in the first pressurizing chamber by moving the first plunger in the first cylinder;

a first mover connected to the first plunger;

a second mover provided to face the first mover in a moving direction of the first plunger, the second mover being configured to serve as a counterweight configured to suppress vibration that occurs due to reciprocating movement of the first mover;

a housing including the first mover and the second mover inside the housing;

an electromagnet provided between the first mover and the second mover;

a magnetic member provided between the first mover and the second mover, the magnetic member being configured to attract both the first mover and the second mover when the electromagnet is energized;

a plate disposed between the first mover and the second mover;

a first spring disposed between the first mover and the plate;

a second spring disposed between the second mover and the plate; and a third spring and a fourth spring being a pair of springs configured to sandwich the plate between the third spring and the fourth spring, each end portion of the third spring and the fourth spring being connected to the housing.

2. The fuel pump according to claim 1, wherein the third spring and the fourth spring are disposed in a pre-compressed state.

3. The fuel pump according to claim 1, further comprising:

a second pump portion including a second cylinder, a second plunger, and a second pressurizing chamber, the second plunger being connected to the second mover, the second plunger being configured to reciprocate in the second cylinder, the second pressurizing chamber being defined by the second cylinder and the second plunger, and the second pump portion being configured to pressurize fuel in the second pressurizing chamber by moving the second plunger in the second cylinder.

4. The fuel pump according to claim 3, wherein a volume of the second pressurizing chamber and a specification of the second plunger are set such that a pressure of the fuel pressurized in the second pressurizing chamber becomes smaller than a pressure of the fuel pressurized in the first pressurizing chamber.

* * * * *